US005960964A

United States Patent [19]

Austin et al.

[11] Patent Number: 5,960,964

[45] Date of Patent: Oct. 5, 1999

[54] METHOD AND APPARATUS FOR SORTING RECYCLED MATERIAL

[75] Inventors: Fred M. Austin; Roy R. Miller; Brian K. Clark, all of Eugene, Oreg.

[73] Assignee: Bulk Handling, Inc., Eugene, Oreg.

[21] Appl. No.: 08/769,506

[22] Filed: Dec. 18, 1996

Related U.S. Application Data

[60] Provisional application No. 60/018,249, May 24, 1996.

[51] Int. Cl.[6] ..... B07B 13/05

[52] U.S. Cl. ..... 209/672; 209/667; 209/353; 209/673

[58] Field of Search ..... 209/672, 673, 209/667, 353

[56] References Cited

U.S. PATENT DOCUMENTS

| | | | |
|---|---|---|---|
| 530,262 | 12/1894 | Distl et al. . | |
| 785,508 | 3/1905 | Mason . | |
| 800,690 | 10/1905 | McDonald . | |
| 1,941,147 | 12/1933 | Johlige . | |
| 2,124,856 | 7/1938 | Kohler | 209/672 |
| 2,350,332 | 6/1944 | Albaugh, Sr. . | |
| 2,370,539 | 2/1945 | Hodecker . | |
| 2,417,921 | 3/1947 | Fox . | |
| 2,588,309 | 3/1952 | Troyer . | |
| 2,743,813 | 5/1956 | Erickson . | |
| 3,367,494 | 2/1968 | Peterson . | |
| 3,870,627 | 3/1975 | Herkes . | |
| 4,301,930 | 11/1981 | Smith . | |
| 4,538,734 | 9/1985 | Gill . | |
| 4,653,648 | 3/1987 | Bielagus . | |
| 4,760,925 | 8/1988 | Stehle et al. . | |
| 4,795,036 | 1/1989 | Williams . | |
| 4,836,388 | 6/1989 | Bielagus . | |
| 4,871,073 | 10/1989 | Bery et al. | 209/672 |
| 4,901,864 | 2/1990 | Daugherty . | |
| 5,024,335 | 6/1991 | Lundell . | |
| 5,051,172 | 9/1991 | Gilmore . | |
| 5,060,806 | 10/1991 | Savage . | |
| 5,163,564 | 11/1992 | Matula . | |
| 5,232,097 | 8/1993 | Tohkala . | |
| 5,361,909 | 11/1994 | Gemmer . | |
| 5,450,966 | 9/1995 | Clark et al. | 209/672 |
| 5,480,034 | 1/1996 | Kobayashi | 209/667 |
| 5,485,925 | 1/1996 | Miller et al. . | |
| 5,558,234 | 9/1996 | Mobley | 209/672 |

FOREIGN PATENT DOCUMENTS

| | | | |
|---|---|---|---|
| 600232 | of 1934 | Germany | 209/672 |
| 592 126 | 1/1934 | Germany . | |
| 618 154 | of 1935 | Germany . | |
| 609 919 | 2/1935 | Germany . | |
| 640551 | of 1937 | Germany | 209/672 |
| 658699 | of 1938 | Germany | 209/672 |
| 1 031 220 | 5/1958 | Germany . | |
| 3926451 C1 | 3/1991 | Germany . | |
| 1406093 A1 | 6/1988 | U.S.S.R. . | |

OTHER PUBLICATIONS

Bulk Handling Systems Product Brochure, BHS Disc–Screens (2 pages).

*Primary Examiner*—Janice L. Krizek
*Assistant Examiner*—Thuy V. Tran
*Attorney, Agent, or Firm*—Marger Johnson & McCollom

[57] ABSTRACT

A compound disc is used to eliminate a secondary slot normally formed between adjacent shafts of a material separation screen. The compound disc comprises a primary disc joined to an associated secondary disc. The primary disc and the secondary disc each have the same shape but the secondary disc has a smaller outside perimeter and is wider. The primary disc and associated secondary disc are formed from a unitary piece of rubber. The compound discs are interleaved with oppositely aligned compound discs on adjacent shafts. In other words, the large disc is positioned on a shaft to align with a smaller disc on an adjacent shaft. The oppositely aligned and alternating arrangement between the large discs and small discs reduces problems that exist in screens that use in-line multi-sided discs.

27 Claims, 11 Drawing Sheets

METHOD AND APPARATUS FOR SORTING RECYCLED MATERIAL

This application claims the benefit of U.S. Provisional Application No. 60/018,249 filed May 24, 1996.

BACKGROUND OF THE INVENTION

1. Field of the Invention

This invention relates to an apparatus and method for separating various materials. In particular, this invention relates to improvements in a unique disc screen that improves the screen's performance and reduces maintenance thereof.

2. Description of the Related Art

Disc or roll screens, as contemplated by the present invention are frequently used as part of a multi-stage materials separating system. Disc screens are used in the materials handling industry for screening large flows of materials to remove certain items of desired dimensions. In particular, disc screens are particularly suitable for classifying what is normally considered debris or residual materials. This debris may consist of various constituents. It may contain soil, aggregate, asphalt, concrete, wood, biomass, ferrous and nonferrous metal, plastic, ceramic, paper, cardboard, or other products or materials recognized as debris throughout consumer, commercial and industrial markets. The function of the disc screen is to separate the materials fed into it by size. The size classification may be adjusted to meet virtually any specific application.

Disc screens generally have a screening bed having a series of rotating spaced parallel shafts each of which has a longitudinal series of concentric screen discs separated by spacers which interdigitate with the screen discs of the adjacent shafts. The relationship of the discs and spacers on one shaft to the discs and spacers on each adjacent shaft form an opening generally known in the industry as the interfacial opening or "IFO". The IFOs permit only material of acceptable size to pass downwardly through the rotating disc bed. The acceptable sized material which drops through the IFO is commonly referred to in the industry as Accepts or Unders.

The discs are all driven to rotate in a common direction from the infeed end of the screen bed to the outfeed or discharge end of the bed. Thus, materials which are larger than the IFO, referred to in the industry as Overs, will be advanced on the bed to the outfeed end of the bed and rejected.

A major problem with such disc screens is jamming. When the discs are not in line, material tends to jam between the disc and the adjacent shaft, physically forcing the screen to stop. Although the jamming phenomenon may not cause the roll screen to stop completely, it may cause momentary stoppages. Such stoppages may not cause the drive mechanism of the roll screen to turn off but may cause substantial mechanical shock. This mechanical shock eventually results in the premature failure of the roll screen's roll assemblies and drive mechanism.

Another problem with disc screens is effectively separating debris having similar shapes. It is difficult to separate office sized waste paper (OWP) and old newspapers (ONP) since much of the OWP and ONP has the same long thin shape. For example, it is difficult to effectively separate notebook paper and ONP from old corrugated cardboard (OCC) since each is long and relatively flat. A secondary slot is formed between the discs on adjacent shafts. OWP and/or OCC is difficult to sort effectively because most categories of OWP and some OCC can slip through the secondary slot. Further, OWP has a tendency to slip off a bottom end of the disc screen, while being transported up the screen at an incline.

Accordingly, a need remains for a system that can classify materials more effectively and is also more resistant to jamming.

SUMMARY OF THE INVENTION

The invention concerns an apparatus for classifying material by size. It comprises a frame, a plurality of shafts mounted on the frame substantially parallel with one another and defining a substantially planar array, means for rotating the shafts in ganged relation to one another, and a plurality of discs mounted on the shafts in a substantially coplanar row, each of the discs having a perimeter shaped to maintain the space between discs substantially constant during rotation.

In accordance with this invention, we disclose a method for classifying material by size. This method comprises defining a plurality of substantially uniform openings disposed between a plurality of shafts arranged to define a substantially planar array, mounting noncircular discs on the shafts in substantially parallel rows, rotating the shafts in the same direction, dropping the material on the shafts at one side of the array so that shaft rotation causes the material to be pushed by the discs across the remainder of the shafts in the array, and maintaining the spacing between discs in a row substantially uniform during rotation.

In an alternative embodiment of the invention, we disclose an apparatus for classifying material by size which includes a frame; a plurality of shafts mounted on the frame substantially parallel with one another; a first stage including discs mounted on the shafts in a substantially coplanar row, each of the discs having a perimeter shaped to maintain the space between discs substantially constant during rotation; and a second stage including discs mounted on the shafts in a substantially coplanar row, each of the discs having a perimeter shaped to maintain the space between discs substantially constant during rotation. The first stage discs are positioned to allow passage of only small fraction material and the second stage discs are positioned to allow passage of intermediate fraction material and thereby classifying the material into a small fraction, an intermediate fraction and a large fraction.

In another embodiment of the invention, a unique screen arrangement increases separating efficiency by moving materials over multiple separation stages. A receiving section agitates debris while the debris moves at an angle up to a given elevation. The agitation of the debris in combination with the angled upward movement promotes separation of the large and small sized :materials. A roll over section drops the materials down to a discharge position for feeding onto a discharge section. The materials are dropped from the roll over section so that the debris either falls vertically downward or flips over further promoting separation. The discharge section again agitates the debris while moving up a second incline until the larger debris discharges out a rear end.

The discs are interdigitized at the front end of the receiving and discharge sections to prevent large materials from falling between the rows of discs. Shafts on the different sections also have separately controllable rotation speeds allow larger materials to be quickly moved out from underneath materials previously dropped from the roll over section.

In yet another embodiment of the invention, a compound disc is used to eliminate secondary slots formed between discs on adjacent shafts in a material separation screen. The compound disc comprises a primary disc joined to an associated secondary disc. The primary disc and the secondary disc each have the same shape but the secondary disc has a smaller outside perimeter than the primary disc. The secondary disc is also wider than the primary disc. In one embodiment, the primary disc and associated secondary disc are formed from a unitary piece of rubber.

The compound discs are interleaved with oppositely aligned compound discs on adjacent shafts. In other words, the large primary disc is positioned on a shaft to align with a smaller secondary disc on an adjacent shaft. The alternating arrangement between the large discs and small discs eliminate secondary slots that normally exist in disc screens. The rubber discs provide additional gripping for flat materials such as paper while inducing oversized materials, such as plastic bottles, to roll off a bottom end of the screen. Thus, the compound disc separates materials more effectively than current disc screens while also reducing jamming.

The foregoing and other objects, features and advantages of the invention will become more readily apparent from the following detailed description of a preferred embodiment of the invention which proceeds with reference to the accompanying drawings.

DETAILED DESCRIPTION OF THE INVENTION

Figure 1:
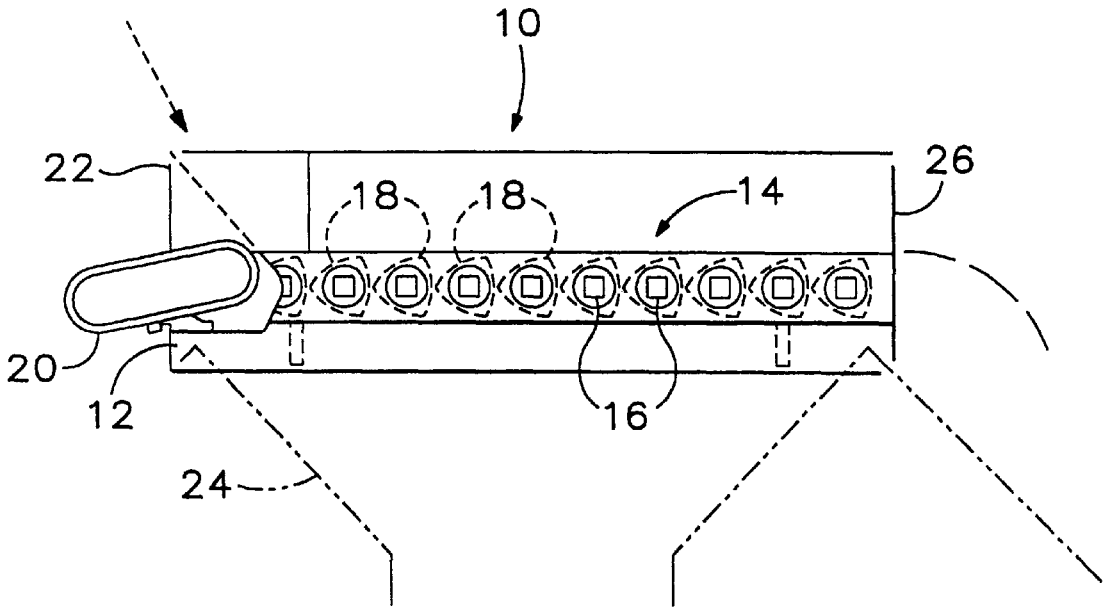
FIG. 1 is a side elevational schematic illustration of a disc screen apparatus embodying the invention.

Referring to FIG. 1, a disc screen apparatus 10 comprising a frame 12 supporting a screening bed 14 having a series of co-rotating spaced parallel shafts 16 of rectangular perimeter and similar length and each of which has a longitudinal series of screen discs 18. The shafts 16 are driven clockwise in unison in the same direction by suitable drive means 20. Material such as debris to be screened is delivered to the infeed end 22 of the screen bed 14 by means of a chute (not shown) as indicated by directional arrows. The constituents of acceptable size (Accepts) drop through the IFOs defined by the discs 18 and are received in a hopper 24. Debris constituents which are too large to pass through the IFOs (Overs) are advanced to and discharged, as indicated by directional arrows, from the rejects end 26 of the screening bed 14.

Figure 2:
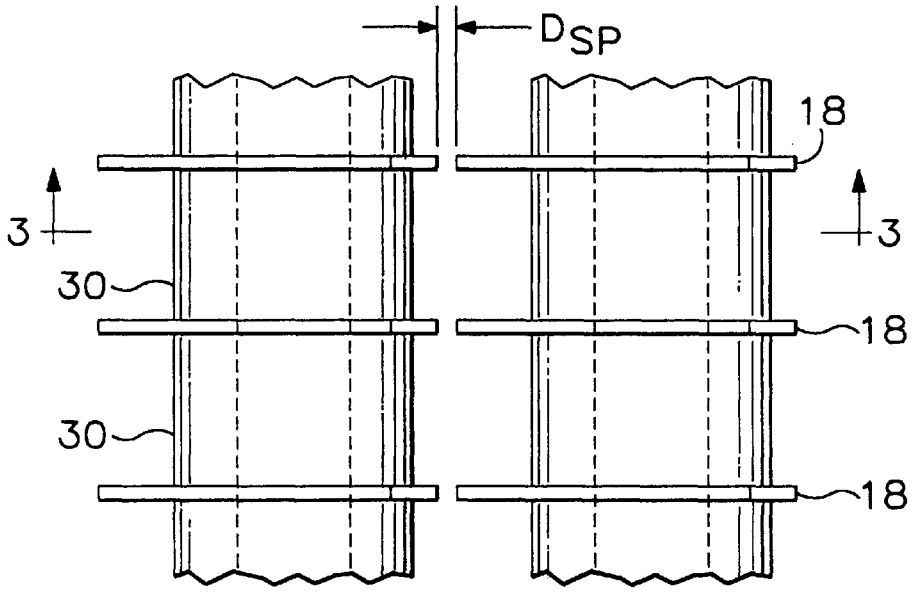
FIG. 2 is an enlarged fragmental top plan view of the screening bed of the apparatus.
Figure 3:
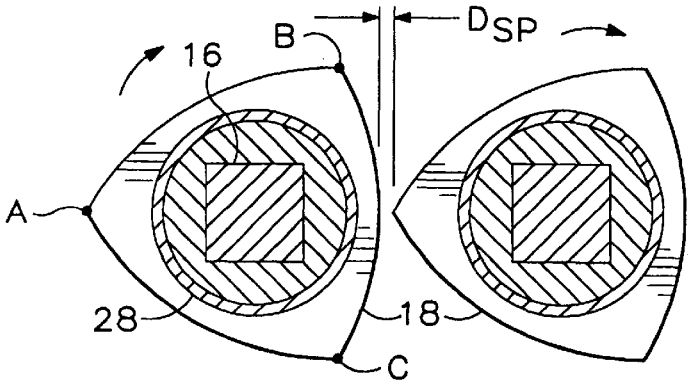
FIG. 3 is a fragmentary vertical sectional detail view taken substantially along the line 3—3 of FIG. 2.

As best seen in FIG. 2, there exists a constant space $D_{SP}$ between discs of adjacent shafts. As best seen in FIG. 3 through FIG. 3*c*, the discs 18 have perimeters shaped so that space $D_{SP}$ remains constant during rotation. Preferably the perimeter of discs 18 is defined by three sides having substantially the same degree of curvature. Most preferably, the perimeter of discs 18 is defined by drawing an equilateral triangle which has vertices A, B, and C. And thereafter drawing three arcs: (1) between vertices B and C using vertex A as the center point of the arc; (2) between vertices C and A using vertex B as the center point for the arc; and (3) between vertices A and B using vertex C as the center point of the arc.

This uniquely shaped disc perimeter provides several advantages. First, although space $D_{SP}$ changes location during the rotation of discs 18 as shown in FIGS. 3–3*c*, the distance between the discs remains constant. In conventional disc screens which have toothed discs which interdigitate, the distance between a disc and its adjacent shaft varies, depending upon the position of the disc during its rotation. This interdigitation action tends to pinch materials between the disc and its adjacent shaft, resulting in frequent jamming.

Another advantage resulting from the uniquely shaped perimeter is that as the discs 18 rotate, they move the debris in an up and down fashion which creates a sifting effect and facilitates classification. This phenomenon produces a disc screen which is very efficient in classifying materials.

Figure 4:
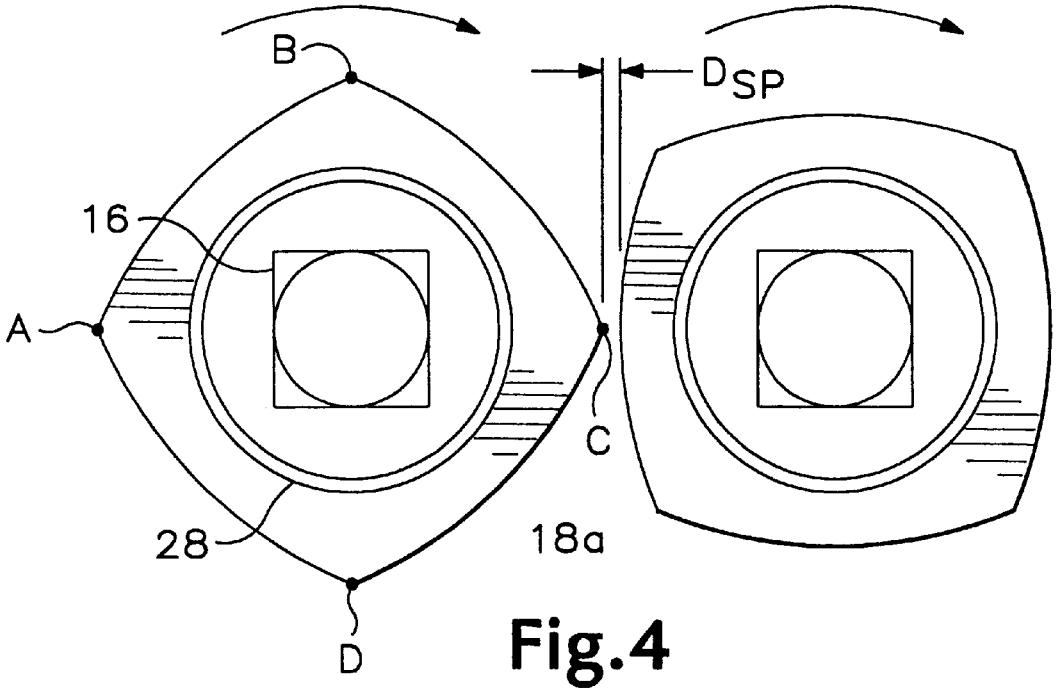
FIG. 4 is a sectional detail view of an alternative embodiment of the invention employing a four-sided disc.

Turning now to FIG. 4, an alternative embodiment of the present invention is shown. FIG. 4 illustrates a four-sided disc 18. Preferably the perimeter of the four-sided disc 18*a* is defined by having four sides having substantially the same degree of curvature. Most preferably, the perimeter of disc 18*a* is defined by (1) determining the desired center distance L between adjacent shafts and then determining the desired clearance or gap $D_{sp}$ between adjacent coplanar discs; (2) drawing a square having corners A, B, C, and D and side length S. The side length S is calculated as follows:

$$S=(L-D_{sp})*\text{COS } 45/\text{COS } 22.5.$$

Arcs are then drawn between corners A and B, B and C, C and D, and D and A. The radii R of the arcs is the difference between distance L and gap $D_{SP}$($R=L-D_{SP}$).

Figure 5:
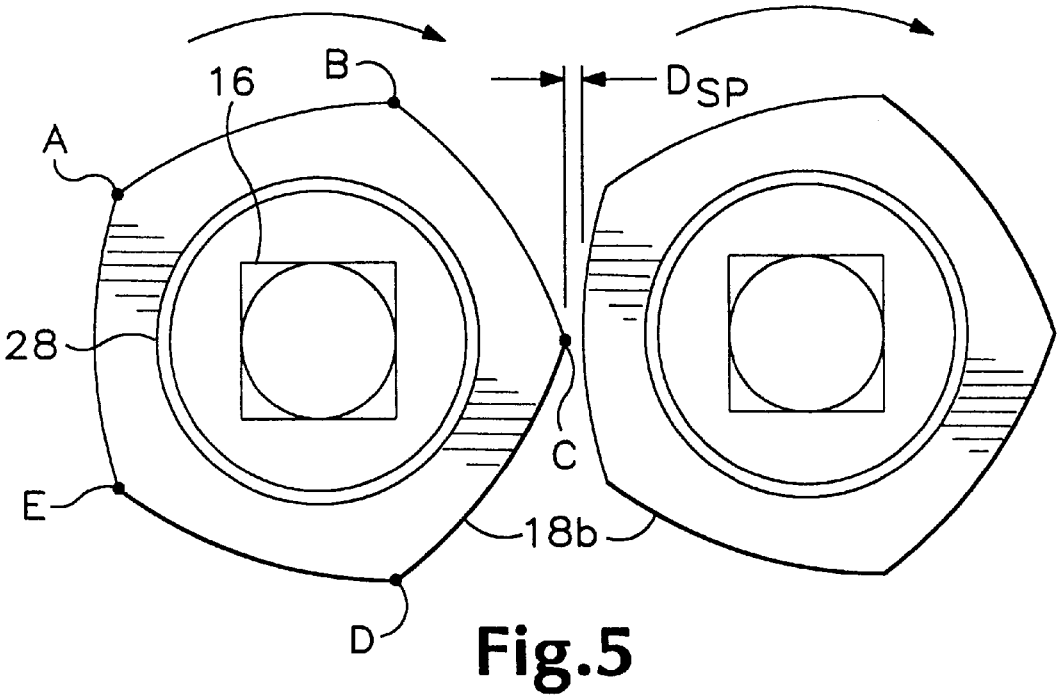
FIG. 5 is a sectional detail view of an alternative embodiment of the invention employing a five-sided disc.

Alternatively, the present invention can employ a five-sided disc 18*b* as illustrated in FIG. 5. Preferably the perimeter of the five-sided disc 18*b* is defined by having five sides having substantially the same degree of curvature. Most preferably, the perimeter of disc 18*b* is defined by drawing a regular pentagon having vertices A, B, C, D, and E. And thereafter drawing five arcs: (1) between vertices A and B using vertex D as the center point of the arc; (2) between vertices B and C using vertex E as the center point of the arc; (3) between vertices C and D using vertex A as the center point of the arc; (4) between vertices D and E using vertex B as the center point of the arc; and (5) between vertices E and A using vertex C as the center point of the arc.

Discs 18*a* and 18*b* are very beneficial in classifying materials which are more fragile or delicate. As the number of sides of the discs are increased, from 3 to 4 or 5 for example, the amplitude of rotation decreases. This effect is quite dramatic when employing larger diameter discs. Higher amplitudes of the sifting action are more likely to damage delicate or fragile materials. On the other hand, fewer sides increases the amplitude and enhances the sifting action of the screen.

For optimum results, care must be exercised to assure that the IFO spacing between the discs 18 be as accurate as practicable. To attain such accuracy, generally flat discs 18 are desirably mounted on the shafts 16 in a substantially coplanar row in substantially parallel relation and radiating outwardly from each of the shafts 16 at right angles to the longitudinal axes of the shafts 16.

Preferably, the discs 18 can be held in place by spacers 30. For this purpose, the spacers 30 comprise central apertures to receive the hubs 28 therethrough. The spacers 30 are of substantially uniform size and are placed between the discs 18 to achieve substantially uniform IFOs.

The use of spacers 30 has numerous advantages. First, the size of the IFOs can be easily adjusted by employing spacers 30 of various lengths and widths corresponding to the desired sized opening without replacing the shafts or having to manufacture new discs. The distance between adjacent discs 18 can be changed by employing spacers 30 of different lengths. Similarly, the distance between adjacent shafts can be changed by employing spacers 30 of different radial widths. Preferably, the shafts 16 can be adjusted to also vary the size of the IFOs. Thus, in this embodiment, manufacturing costs are greatly reduced as compared to mounting of the discs directly on the shaft. Moreover, damaged discs can be easily replaced.

Alternatively, the discs 18 are mounted by sets concentrically and in axially extending relation on hubs 28 complementary to and adapted for slidable concentric engagement with the perimeter of the shafts 16. For this purpose, the discs 18 comprise central apertures to receive the hubs 28 therethrough. The discs 18 are attached in substantially accurately spaced relation to one another axially along the hubs 28 in any suitable manner, as for example by welding.

Depending on the character and size of the debris to be classified, the discs 18 may range from about 4 inches major diameter to about 24 inches major diameter. Again, depending on the size, character and quantity of the debris, the number of discs per shaft range from about 5 to about 60.

Figure 6:
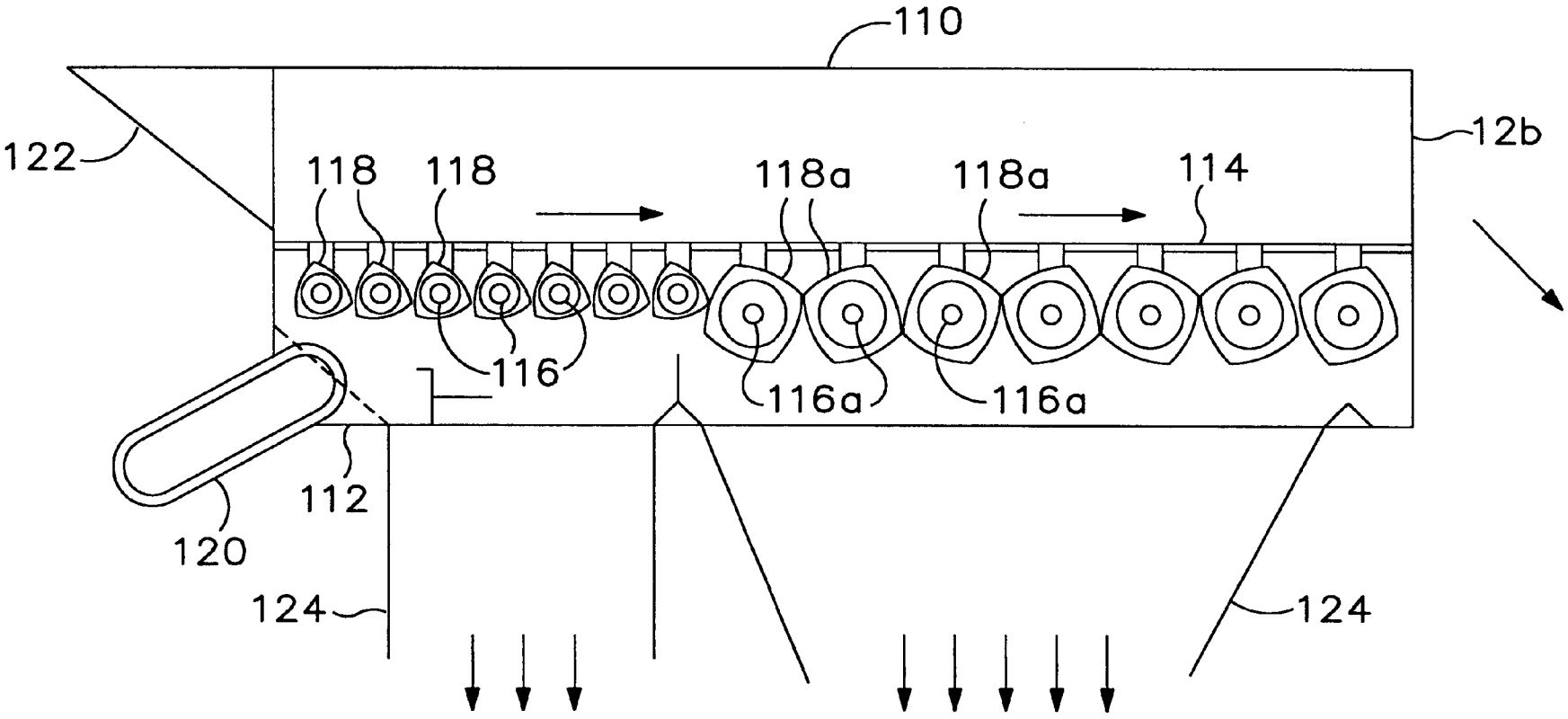
FIG. 6 is a side elevational schematic illustration of an alternative embodiment of the invention.

Referring to FIG. 6, an alternative embodiment of the invention is illustrated. A disc screen 110, comprising a frame 112 supporting a screening bed 114 having a first stage of co-rotating spaced parallel shafts 116 of similar length and each of which has a longitudinal series of screen discs 118 and having a second stage of co-rotating spaced parallel shafts 116*a* of similar length and each of which has a longitudinal series of screen discs 118*a*. The shafts 116 and 116*a* are driven clockwise as hereafter described in the same direction by suitable drive means 120. Material such as debris to be screened is delivered to the infeed end 122 of the screen bed 114 by means of a chute (not shown) as indicated by directional arrows. In the first stage of the apparatus 110, only constituents of the smallest fraction of debris drop through the IFO's defined by the discs 118 and are received in a hopper 124 as indicated by directional arrows. Debris constituents which are too large to pass through the IFO's defined by discs 118 are advanced to the second stage of the apparatus 110. In the second stage, constituents of intermediate fraction of debris drop through the IFO's defined by the discs 118*a* and are received in a hopper 124*a* as indicated by directional arrows. Debris constituents which are too large to pass through the IFO's defined by discs 118*a* are advanced to and discharged, as indicated by directional arrows, from the rejects end 126 of the screening bed 114. Screening debris by way of this embodiment of the invention results in classifying the debris into three fractions: small, intermediate, and large.

In general the small fraction material comprises particles having a diameter of less than about 4 inches and the intermediate fraction material comprises particles having a diameter of less than about 8 inches. Preferably the small faction material particles have a diameter of less than 3 inches and the intermediate fraction material particles have a diameter of less than 6 inches. Most preferably, the small fraction particles have diameters of less than 2 inches and the intermediate fraction particles have diameters of less than 4 inches.

In general, debris traveling horizontally through the first stage travels at a velocity ranging from about 50 to 200 feet per minute (FPM) and the debris traveling horizontally through the second stage at a velocity from about 50 to 250 FPM. Preferably the first stage debris travels at a velocity of about 75 to 150 FPM, most preferably from about 120 FPM; and the second stage debris travels at a velocity ranging from about 100 to 200 FPM, most preferably from about 146 FPM.

Although many combinations of first stage and second stage velocities may be chosen, it is desirable that the first stage and second stage discs rotate in cooperation with one another. To maintain a constant gap between the last row of the first stage discs and the first row of second stage discs, the discs must rotate so that the peak or points of the first stage disc correspond to the sides or valleys of the second stage discs. This relationship is maintained by the following formula:

$$(\mathrm{RPM})_1=(S_2S_1)\ (\mathrm{RPM})_2$$

where (RPM), and $(\mathrm{RPM})_2$ are the revolutions per minute of the first stage discs and second stage discs, respectively, and $S_1$ and $S_2$ are the number of sides of the first stage discs and the second stage discs respectively. For example, for a two stage screen using 3 and 4 sided discs, $(\mathrm{RPM})_1=\frac{4}{3}(\mathrm{RPM})_2$. That is, the four-sided second stage discs are rotated at ¾ the rotation speed of the three-sided first stage disc to maintain proper spacing.

As with other previously discussed embodiments of the invention, discs 118 and 118*a* have perimeters shaped so that space $D_{SP}$ remains constant during rotation. Preferably the perimeter of discs 118 is defined by three sides having substantially the same degree of curvature and defined as shown in FIGS. 2–3*c*. Similarly, the perimeter of discs 118*a* is defined by four sides having substantially the same degree of curvature and defined as shown in FIG. 4.

Multi-stage disc screens have several advantages. First, additional stages allows the user to classify material into multiple factions of increasing size. In addition, multiple stage classifying using a screen results in more efficient separation. Because the velocity of the second stage is greater than the first stage discs, the material speeds up and tends to spread out when passing from the first stage to the second stage of the bed. This in turn accelerates the separation process and results in more efficient screening.

In alternative embodiments of the invention, additional stages are added to the apparatus to provide further classifying of the debris to be screened For example, a three stage screen is employed where the first stage comprises three sided discs, the second stage comprises four-sided discs, and third stage comprises five-sided discs. Here $(RPM)_2=\frac{3}{4}(RPM)_1$, and $(RPM)_3=\frac{3}{5}(RPM)_1$. Classifying debris with this embodiment of the invention would produce four fractions of debris having graduated sized diameters.

Figure 7:
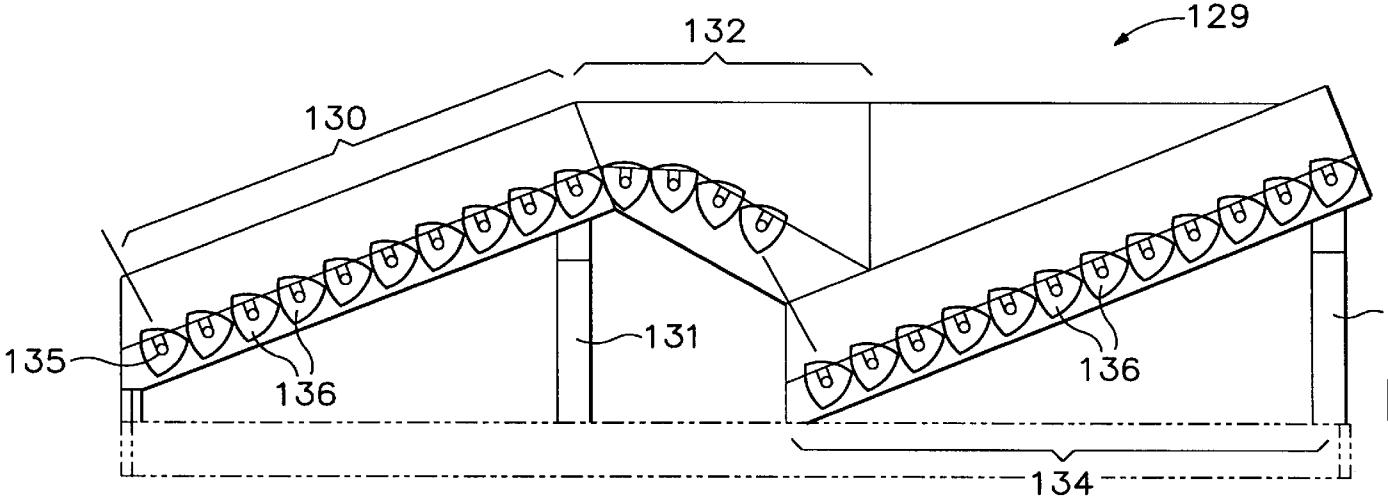
FIG. 7 is a side sectional view of a multistage screen for separating office sized waste paper according to another alternative embodiment of the invention.
Figure 8:
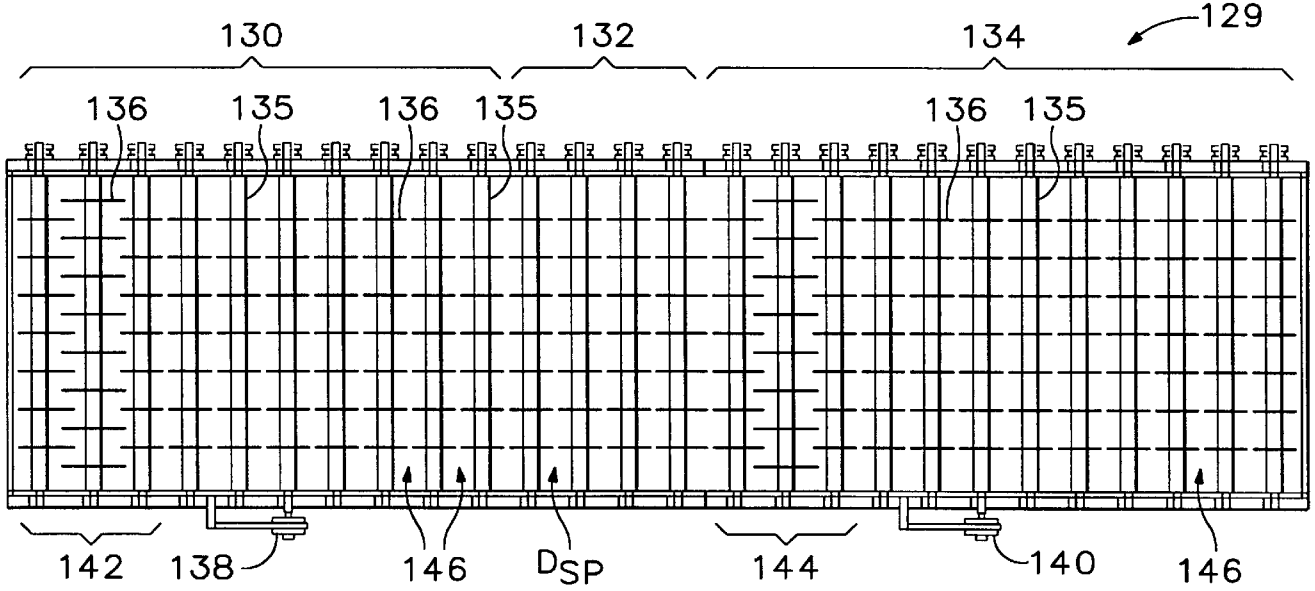
FIG. 8 is a top plan view of the multistage screen shown in FIG. 7.

Referring to FIGS. 7 and 8, a multistage screen 129 includes discs 136 similar to discs 18 previously shown in FIG. 1. The screen 129 comprises a receiving section 130 that inclines upward at an angle of approximately 20 degrees. Receiving section 130 is supported by a pillar 131. A roll over section 132 is attached to the rear end of receiving section 130 and provides a slight downwardly sloping radius that extends over the front end of a discharge section 134. The discharge section 134 also inclines at an angle of approximately 20 degrees and is supported by a pillar 133. Sections 130, 132, and 134 each include a series of co-rotating parallel shafts 135 that contain a longitudinal series of screen discs 136. The shafts 135 contained in sections 130 and 132 are driven in unison in the same clockwise direction by drive means 138. The shafts 135 in section 134 are driven by a separately controllable drive means 140.

Referring specifically to FIG. 8, the discs 136 on the first three rows 142 of shafts 135 in receiving section 130 overlap in an interdigitized manner. Specifically, discs 136 on adjacent shafts extend between longitudinally adjacent discs on common shafts. The discs on the first three rows 144 of shafts 135 in discharge section 134 overlap in the same manner as the discs on rows 142. The discs on subsequent rows after rows 142 and 144 are aligned in the same longitudinal positions on each shaft 135. Discs 136 on adjacent shafts 135 in the same longitudinal positions have outside perimeters that are spaced apart a distance $D_{sp}$ of between ⅜ to ½ inches. The small distance between the discs on adjacent shafts form secondary slots 146.

Figure 3A:
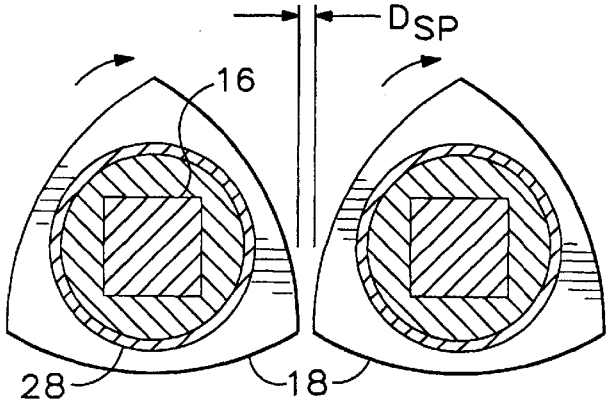
FIG. 3*a* is a sectional detail view, as depicted in FIG. 3, where the adjacent discs are rotated 90 degrees about their respective horizontal axes.
Figure 3B:
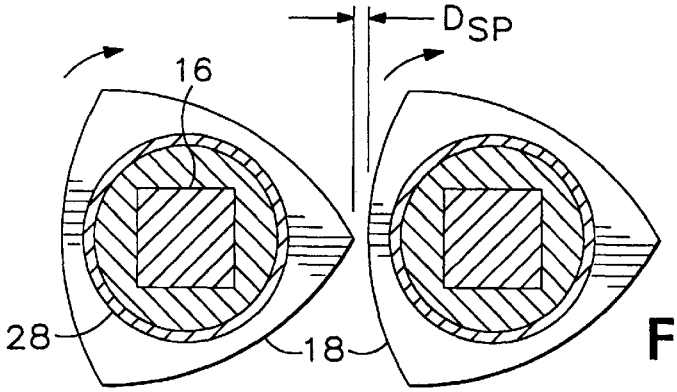
FIG. 3*b* is a sectional detail view, as depicted in FIG. 3, where the adjacent discs are rotated 180 degrees about their respective horizontal axes.
Figure 3C:
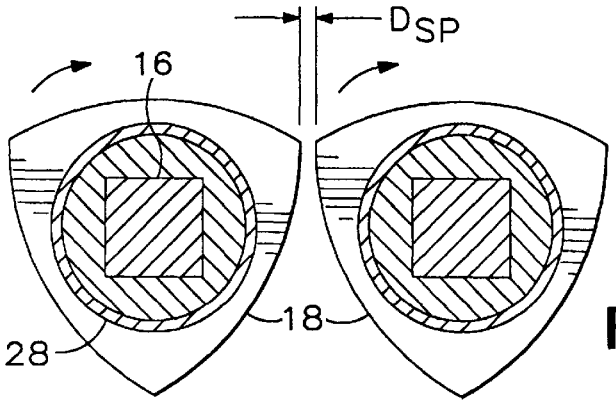
FIG. 3*c* is a sectional detail view, as depicted in FIG. 3, where the adjacent discs are rotated 270 degrees about their respective horizontal axes.

The discs 136 are all aligned and rotated in phase to maintain the same relative angular positions during rotation as previously shown in FIGS. 3A–3C. Thus, the distance $D_{SP}$ between discs remains constant as the shafts 135 rotate the discs 136 in a clockwise direction. The constant distance of the secondary slots 146 allow precise control over the size of debris that falls down through screen 129. Also as described above, the unique tri-arch shaped perimeter of the discs 136 move debris longitudinally along the screen 129 while at the same time moving the debris vertically up and down. The up and down motion of the debris while moving up the screen at an angle creates a sifting effect that facilitates classification as described below.

Figure 9:
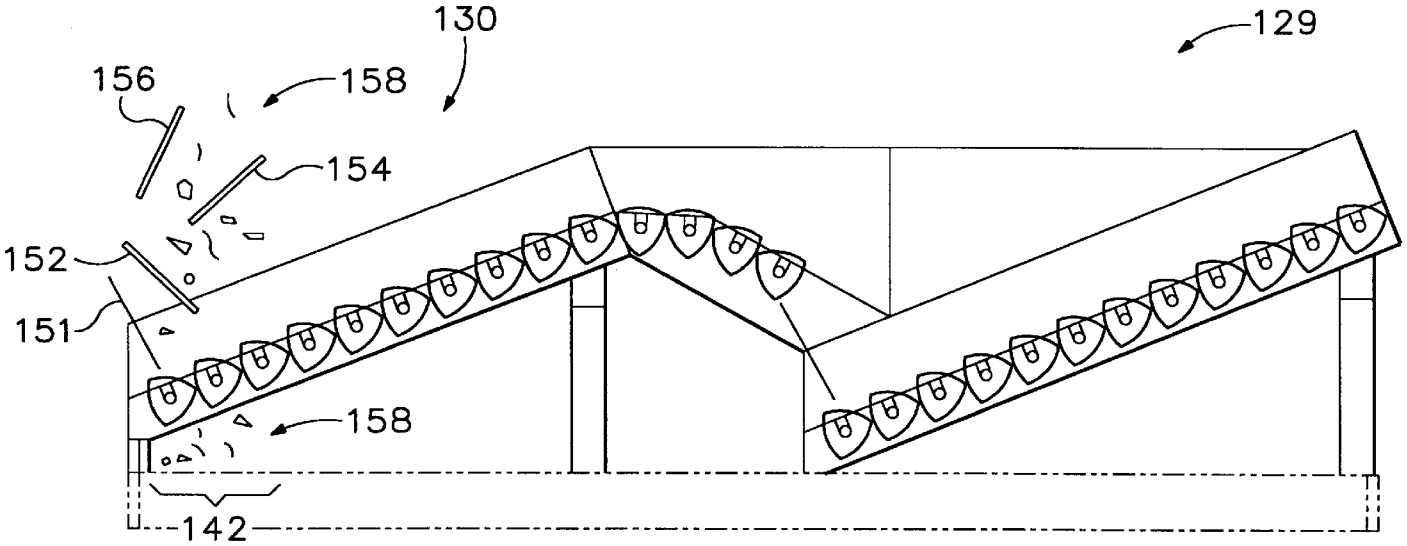
FIGS. 9–13 are a series of side views showing material moving through different separation stages of the multistage screen shown in FIG. 7.

Referring to FIGS. 9–13, the multistage screen operates in the following manner. As shown in FIG. 9, common office size waste paper (OWP) includes pieces of old corrugated cardboard (OCC) 152–156 and pieces of 8½ inch×11 inch paper 158. The OWP is carried by a conveyer (not shown) and dumped through a chute (not shown) onto receiving section 130. Much of the paper 158 falls between the discs 136 and onto a conveyer or large bin (not shown) below screen 129. The overlapping discs on rows 142 (FIG. 8) prevent the OCC 152–156 from falling through receiving section 130.

Figure 10:
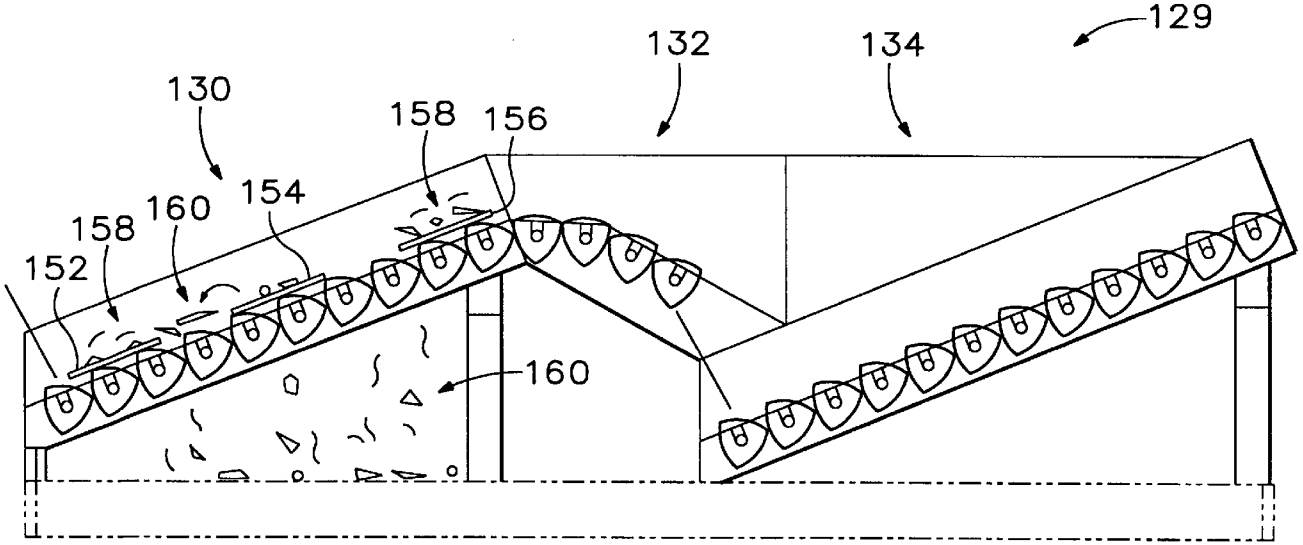

Referring to FIG. 10, the OCC 152–156 after being dropped onto screen 129 lies flat on top of the discs 136. Because the OCC 152–156 now lies in a parallel alignment with the upwardly angled direction of receiving section 130, the OCC is not in danger of falling between adjacent rows of discs. Thus, the discs 136 on adjacent shafts can be aligned in the same lateral positions forming the secondary slots 146 shown in FIG. 8.

As the OCC 152–156 falls flat on the screen 129, some paper 158 falls on top of the OCC preventing the paper 158 from falling through receiving section 130. The tri-shaped outside perimeter of the discs 136 in combination with the inclined angle of receiving section 130 agitates the OCC 152–156 forcing some of the paper 160 to slide off the rear end of the OCC and through the screen 129. The secondary slots 146 (FIG. 8) provide further outlet for the paper 160 to fall through screen 129.

Figure 11:
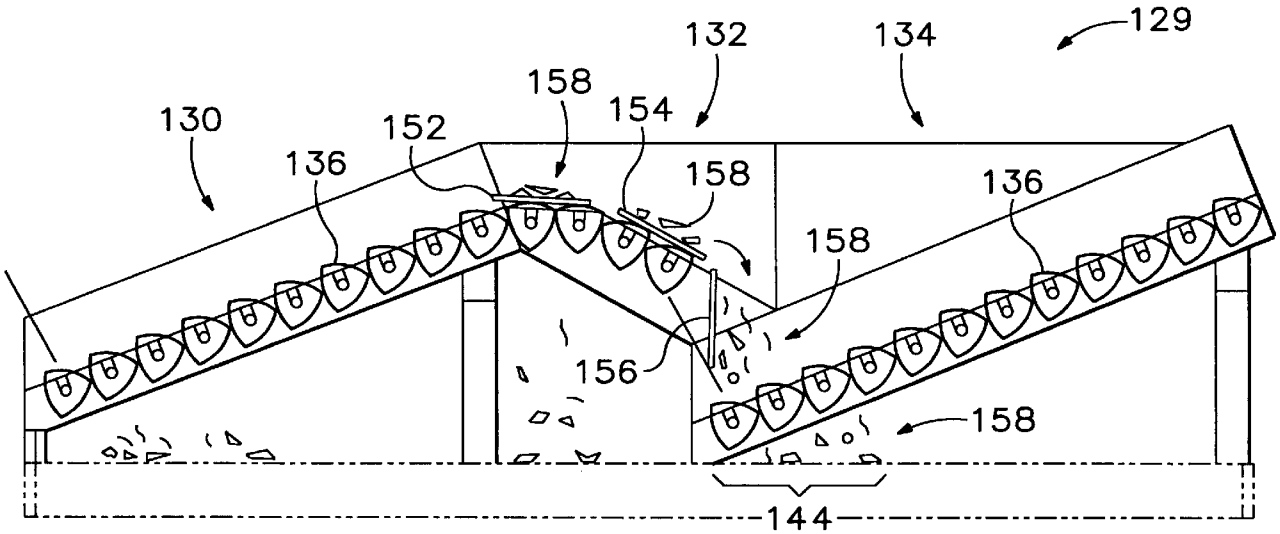

Referring to FIG. 11, to further promote separation, the OCC 152–156 is dropped or "flipped over" onto discharge section 134. Paper 158 which would normally not be separated during the disc agitation process performed by receiving section 130 is more likely to be dislodged by dropping the OCC vertically downward or flipping the OCC over. However, simply sending the OCC 152–156 over the top of receiving section 130 would launch the OCC in a horizontal direction onto discharge section 134. This horizontal launching direction is less likely to dislodge paper 158 still residing on the OCC. Launching also increases the possibility that the OCC will not land on discharge section 134.

Roll over section 132 contains rows of discs that orient the OCC 152–156 in a sight downwardly sloping direction (OCC 154). When the OCC is dropped from screen section 132 in this downwardly sloping orientation, the OCC will either drop down onto section 134 in a vertical direction or will flip over, top side down, as shown by OCC 156. Thus, paper 158 on top of OCC 156 is more likely to become dislodged and fall through discharge section 134. As described above in FIG. 8, the first three rows 144 in discharge section 134 have overlapping discs that prevent OCC from passing through the discs 136. Referring back to FIG. 8, the shafts in receiving section 130 and roll over section 132 are rotated by drive means 138 and the shafts 135 in discharge section 134 are separately rotated by dive means 140. The shafts in discharge section 134 are rotated at a faster speed than the shafts in sections 130 and 132. Thus, OCC 152–156 dropped onto discharge section 134 will not keep paper 158 from falling through screen 129.

Figure 12:
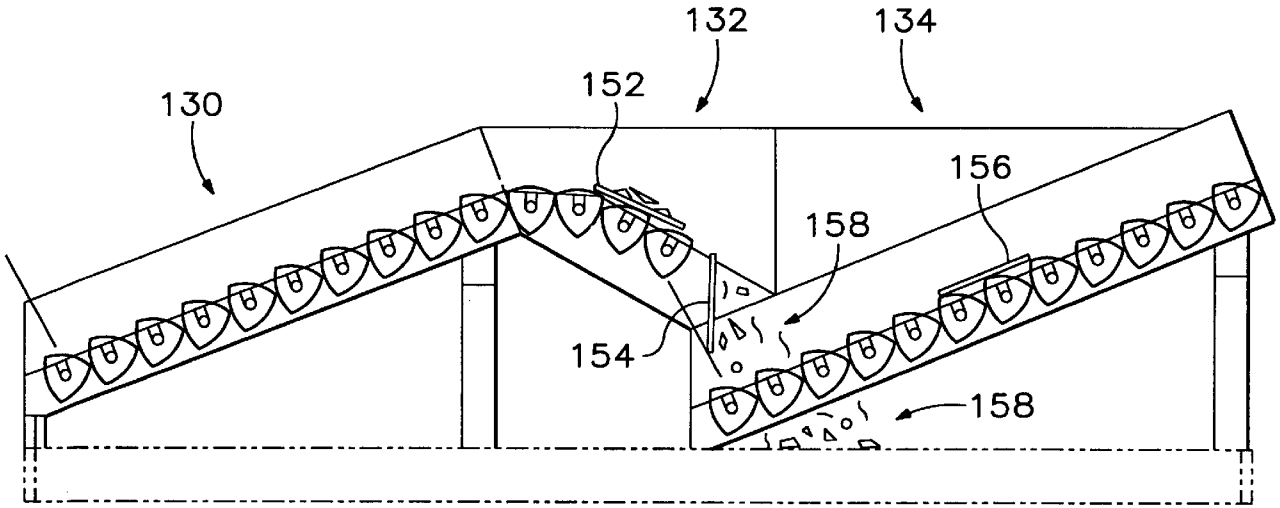
Figure 13:
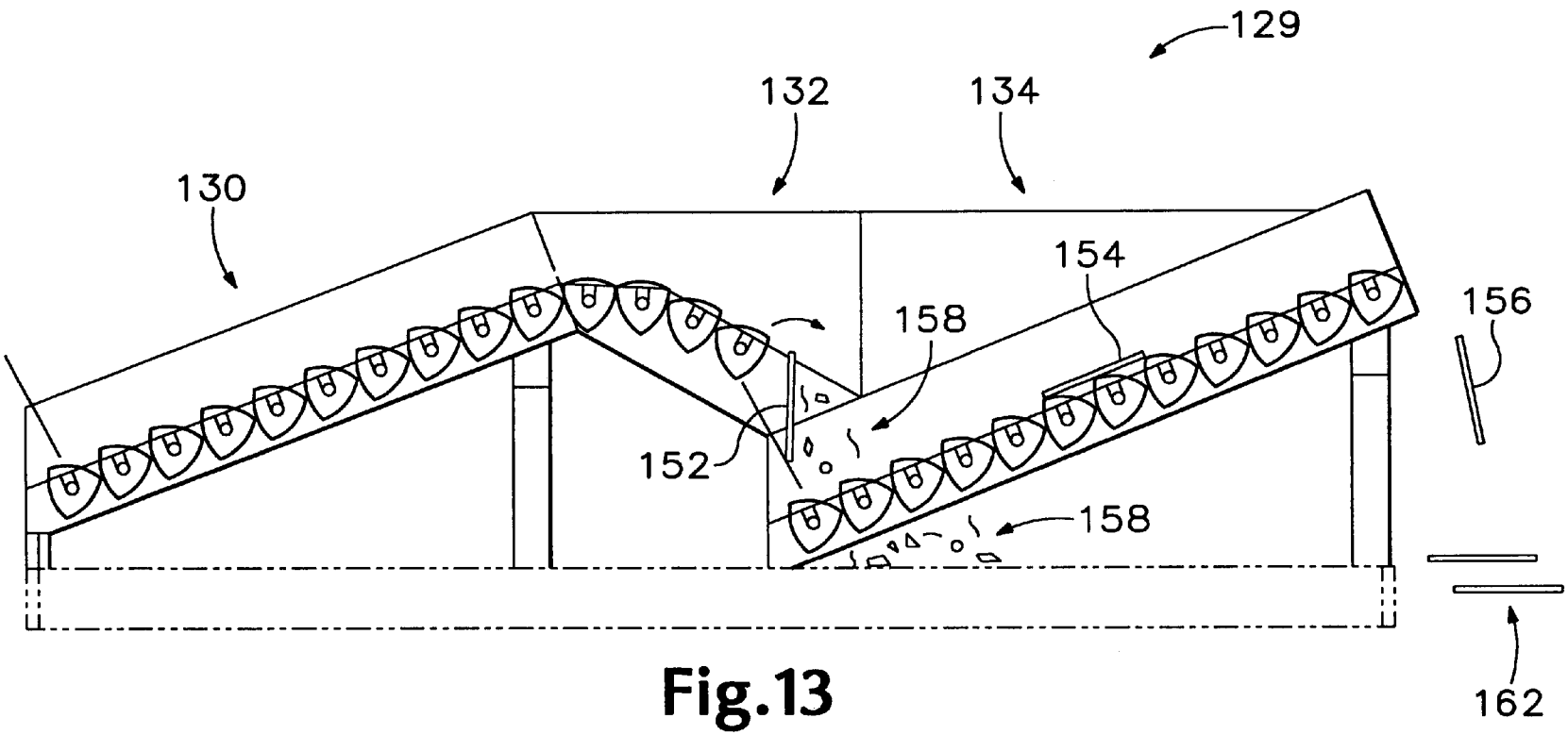

To explain further, FIG. 12 shows the OCC 156 being moved quickly up discharge section 134 out from under the rear end of roll over section 132. Thus, OCC 156 is sufficiently distanced out from under roll over section 132 before OCC 154 is dropped onto discharge section 134. As a result, paper 158 falling from OCC 154 will not land on OCC 156 allowing free passage through discharge section 134. FIG. 13 shows the separated OCC 156 being dropped onto a pile 162 of OCC at the end of discharge section 134.

The multistage screen 129 provides four separation stages as follows:

1) Dropping OWP onto receiving section 130;
2) Agitating the OWP while moving at an angle up receiving section 130;
3) Angling and then dropping the OWP from roll over section 132 so that the OCC falls in a vertical angle or flips over onto discharge section 134; and 4) Agitating the OWP while moving at an angle up discharge section 134.

As a result of the multiple separation stages, the screen 129 is effective in separating OWP, ONP and smaller matter having similar shapes and sizes.

Referring back to FIG. 2, a secondary slot $D_{sp}$ extends laterally across the screen. The slot $D_{sp}$ is formed by the space that exists between discs 18 on adjacent shafts. The secondary slot $D_{sp}$ allows unintentional accepts for some types of large thin material, such as cardboard. The large materials pass through the screen into a hopper 24 (FIG. 1) along with smaller material. The large materials must then be separated by hand from the rest of the accepts that fall into hopper 24. Thus, the secondary slot $D_{sp}$ reduces screening efficiency in disc based screening systems.

Figure 14C:
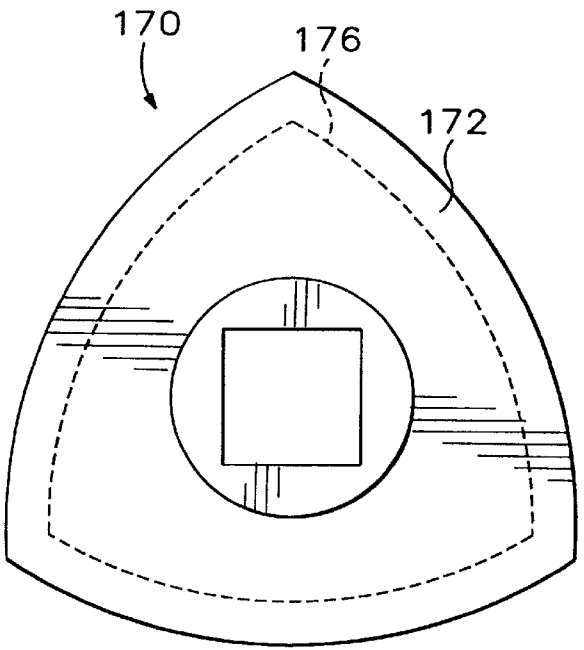
FIGS. 14*a*–14*c* show a front view, side view and perspective view, respectively, of a compound disc according to another aspect of the invention.
Figure 14B:
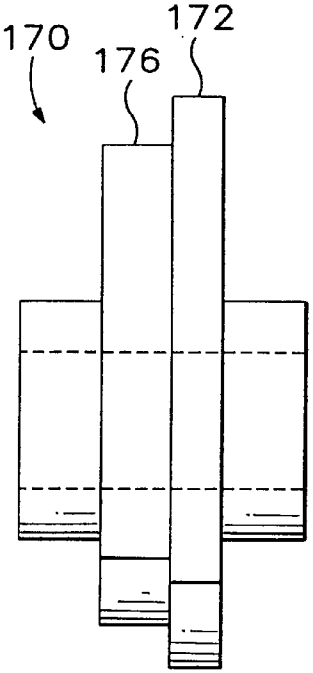
Figure 14A:
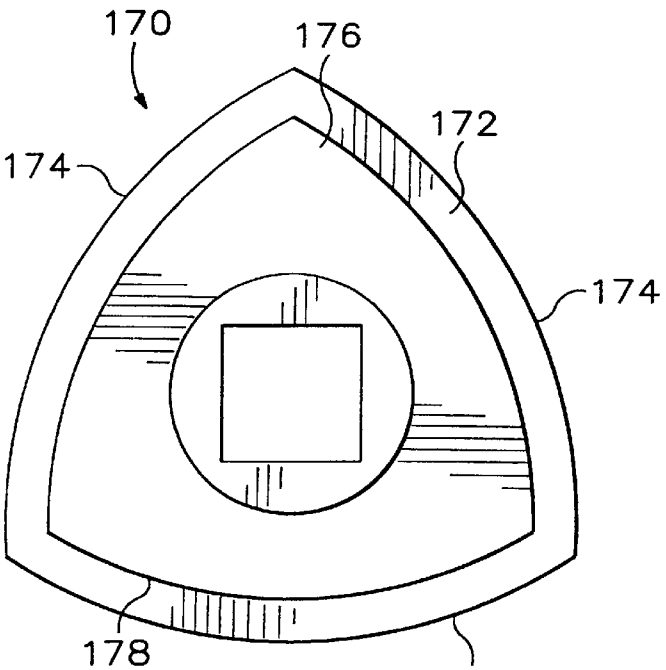

Referring to FIGS. 14*a*–14*c*, a compound disc 170 is used to eliminate the secondary slot $D_{sp}$ that extends between discs on adjacent shafts. The compound disc 170 includes a primary disc 172 having three arched sides 174 that form an outside perimeter substantially the same shape as disc 18 in FIG. 3. A secondary disc 176 extends from a side face of the primary disk 172. The secondary disc 176 has three arched sides 178 that form an outside perimeter substantially the same shape as disc 18 in FIG. 3. However, the outside perimeter of the secondary disc 176 is smaller than the outside perimeter of the primary disc 172 and is approximately twice as wide as the width of the primary disc 172.

During rotation, the arched shape of the primary disc 172 and the secondary disc 176 maintain a substantially constant spacing with similarly shaped discs on adjacent shafts. However, the different relative size between the primary disc 172 and the secondary disc 176 eliminate the secondary slot $D_{sp}$ that normally exists between adjacent shafts. The compound disk 170 is made from a unitary piece of rubber or can be made from two pieces of steel, one taking the shape of the primary disc and one taking the shape of the secondary disc. The rubber material grips onto certain types and shapes of materials providing a more effective screening process as described below.

Figure 15:
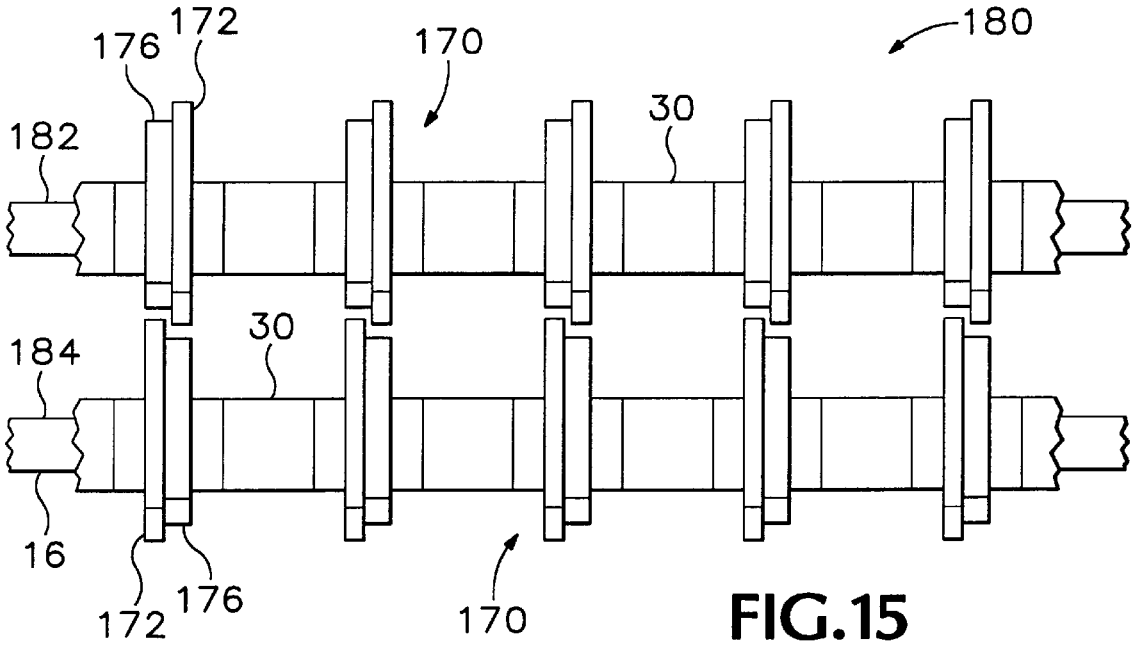
FIG. 15 is a top plan view of a disc screen section using the compound disc in FIGS. 14*a*–14*c*.

Referring to FIG. 15, a portion of a screen 180 includes a first shaft 182 and a second shaft 184 mounted to a frame (not shown) in a substantially parallel relationship. A first set of primary discs 172 and associated secondary discs 176 are mounted on the first shaft 182 and separated by spacers 30. A second set of primary discs 172 are mounted on the second shaft 184 and are aligned laterally on shaft 184 with secondary discs 176 on the first shaft 182. A second set of secondary discs 176 are mounted on the second shaft 184 and align laterally with primary discs 172 on the first shaft 182.

The primary discs 172 on the first shaft 182 and the secondary discs 176 on the second shaft 184 maintain a substantially constant spacing during rotation. The secondary discs 176 on the first shaft 182 and the primary discs 172 on the second shaft 184 also maintain a substantially constant perimeter spacing during rotation. Thus, jamming that typically occurs with toothed discs is substantially reduced.

The alternating alignment of the primary discs 172 with the secondary discs 176 both laterally across each shaft and longitudinally between adjacent shafts eliminate the rectangularly shaped secondary slots $D_{sp}$ that normally extends laterally across the entire width of the screen 180. Since large thin materials, such as cardboard, can no longer unintentionally pass through the disc screen via the secondary slot $D_{sp}$, oversized materials are more accurately separated and deposited in the correct location with other oversized materials.

The compound disc 170 is shown as having a triangular profile with three arched sides. However, the compound discs can have any number of arched sides such as shown by the four sided discs in FIG. 4 and the five sided discs in FIG. 5. In one embodiment of the invention, the primary disc 172 and the associated secondary disc 176 are formed from the same piece of rubber. However, the primary discs and associated secondary discs can also be formed from separate pieces of rubber. If a rubber material is not required for screening materials, the primary and secondary discs may be formed from either a unitary piece of metal of from two separate pieces of metal.

Figure 16:
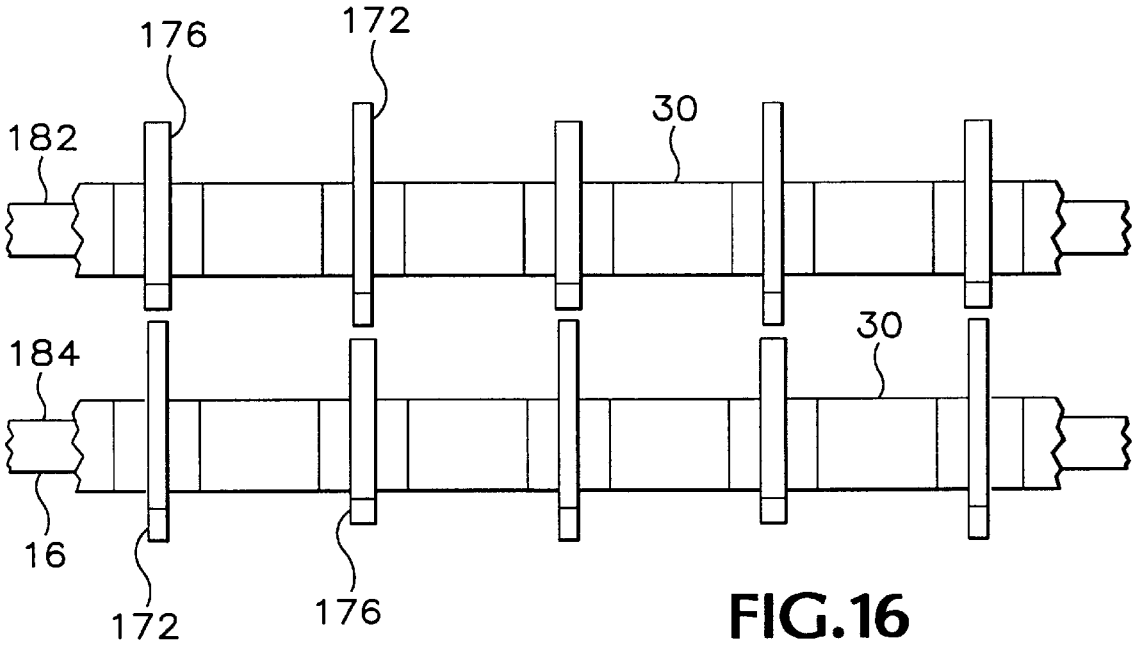
FIG. 16 is a top plan view of a disc screen section using the compound disc in FIGS. 14*a*–14*c* according to another embodiment of the invention.

FIG. 16 is an alternative embodiment of the invention. The primary discs 172 and secondary discs 176 are separate pieces formed from either rubber or from a metal material. The primary discs 172 are mounted laterally across the shaft 182 between secondary discs 176 and separated by spacers 30. The primary discs 172 are mounted laterally across shaft 184 in alignment with primary discs on shaft 182. In turn, the secondary discs on shaft 184 are aligned with primary discs 172 on shaft 182.

The different sizes and alignment of the discs on the adjacent shafts 182 and 184 create a stair-step shaped spacing between the discs on the two adjacent shafts. Different spacing between the primary discs 172 and secondary discs 176, as well as the size and shapes of the primary and secondary discs can be varied according to the types of materials being separated. For example, for separation of larger sized materials, the configuration in FIG. 15 is used. For separation of smaller sized material, the configuration in FIG. 16 is used.

Figure 17:
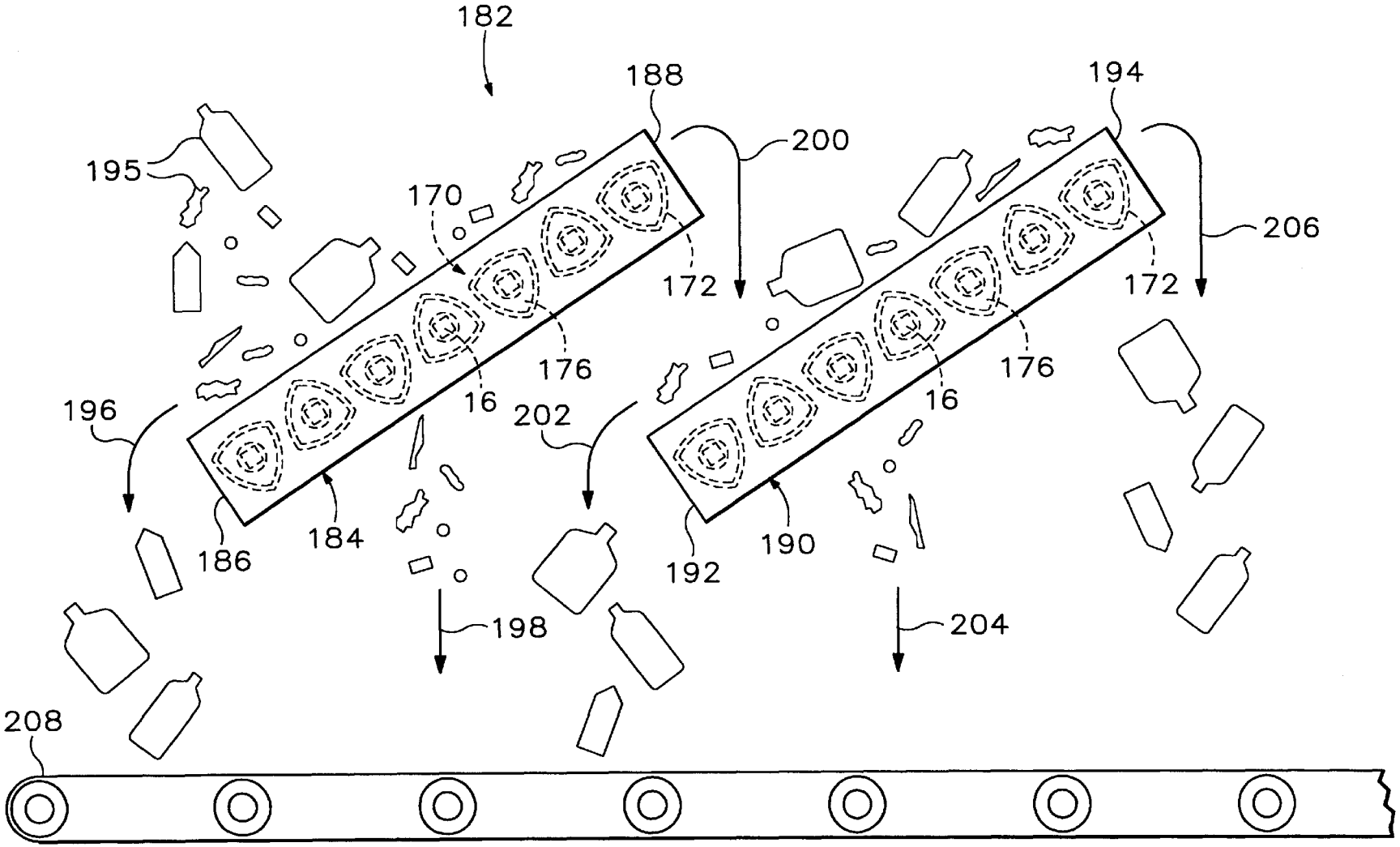
FIG. 17 is a side elevation view of a two stage screen system using the compound disc shown in FIGS. 14*a*–14*c*.

FIG. 17 shows a two stage screen 182 that uses the compound disk 170 shown in FIGS. 14*a*–14*c*. A first frame section 184 is angled at an upward incline from a bottom end 186 to a top end 188. A second frame section 190 is angled at an upward incline adjacent to the first frame section 184 and includes a bottom end 192 and a top end 194. Multiple shafts 16 are attached on both the first frame section 184 and the second frame section 190. Multiple primary discs 172 and associated smaller secondary discs 178 are aligned in rows on each one of the shafts 16 as previously shown in either FIG. 15 or FIG. 16. Each one of the primary discs 172 on the shafts 16 are aligned longitudinally on screen 182 with a secondary disc 178 on adjacent shafts 16.

Materials 195 are categorized as either oversized (large) items or sized (small) items. The unsorted materials 195 are dropped onto the bottom end of screen section 184. Due to gravity, some of the oversized materials drop or roll off the bottom end of screen section 184 onto a conveyer or bin 208, as shown by arrow 196. For example, certain large round items, such as jugs and cartons are more likely to roll off the bottom end 186 of screen section 184 than smaller flat materials. The rubber compound discs 170 grip the smaller sized materials preventing them from sliding off the bottom end of screen section 184. While in rotation, the rubber compound discs 170 help transport the smaller sized materials up the screen while inducing additional oversized materials to roll back off the bottom end 186 of screen section 184.

The remaining materials 195 are agitated up and down by the arched shape discs while being transported up the angled screen section 184. The vibration, in conjunction with the spacing between the discs (FIGS. 15 and 16) shifts the smaller sized materials through the screen, as shown by arrow 198, onto a conveyer or bin. The stair-step spacing, created by the large prinmary discs 172 and small secondary discs 176, prevent oversized materials from falling through the screen section 184.

The materials 195 reaching the top end 188 of screen section 184 are dropped onto the bottom end 192 of the second screen section 190, as represented by arrow 200. Some of the oversized materials roll off the bottom end 192 of screen section 190 into the collection conveyer 208 as represented by arrow 202. The remaining material 195 is vibrated up and down by the compound discs 170 while being transported up screen section 190. Remaining smaller sized materials are sifted through the screen section 190 as represented by arrow 204. The remaining oversized material is transported over the top end 194 of screen section 190 and dropped into an oversized material bin or conveyer 208.

The rubber compound discs 170 in one embodiment allows only paper material to be conveyed up the surface of the screen 182 at a specific angle of incline. The angle of the screen is set between 25 and 45 degrees from horizontal to achieve the proper separation of newspaper from containers. The system described above allows less than 1% of containers or glass fragments to remain commingled with paper products, such as newspaper, after reaching the top end 194 of screen section 190. Thus, the rubber compound discs in combination with the dual-stage screen assembly provide more effective material separation than current disc screen systems and single stage material separation systems.

It will be understood that variations and modifications may be effected without departing from the spirit and scope of the novel concepts of this invention.

What is claimed is:

1. A disc for a material separation screen, comprising:

a primary disc on a first shaft having a first outside perimeter shaped to maintain a substantially constant spacing with a first adjacent disc on a second shaft during rotation;

a secondary disc on the first shaft having a second outside perimeter smaller than the first outside perimeter and shaped to maintain a substantially constant spacing with a second adjacent disc on the second shaft during rotation, the second adjacent disc having an outside perimeter larger than the first adjacent disc; and the primary disc and the first adjacent disc having about the same spacing location as the spacing location between the secondary disc and the second adjacent disc but at a different spacing location.

2. A disc according to claim 1 wherein the primary disc and the secondary disc each comprise arched sides.

3. A disc according to claim 1 wherein the first outside perimeter and the second outside perimeter each comprises three arched sides.

4. A disc according to claim 1 wherein the secondary disc is joined together with the primary disc as one unitary piece of material with the secondary disc formed on and extending from a lateral side of the primary disc.

5. A disc according to claim 1 wherein the secondary disc is wider than the primary disc.

6. A disc for a material separation screen, comprising:

a primary disc on a first shaft having a first outside perimeter shaped to maintain a substantially constant spacing with a first adjacent disc on a second shaft during rotation;

a secondary disc on the first shaft having a second outside perimeter smaller than the first outside perimeter and shaped to maintain a substantially constant spacing with a second adjacent disc on the second shaft during rotation;

the primary disc and the first adjacent disc having a different spacing location than the spacing location between the secondary disc and the second adjacent disc; and the primary disc and the secondary disc are formed from a unitary piece of molded rubber or plastic.

7. A disc according to claim 6 wherein the secondary disc is about twice as wide as the primary disc.

8. A screen for separating material, comprising:

a frame;

a first shaft mounted on the frame;

a second shaft mounted to the frame in a substantially parallel relationship with the first shaft;

a primary disc and an associated secondary disc mounted on the first shaft; and a primary disc mounted laterally on the second shaft in alignment with the secondary disc on the first shaft and an associated secondary disc mounted laterally on the second shaft in alignment with the primary disc on the first shaft;

each primary disc having a larger outside perimeter than the associated secondary disc.

9. A screen according to claim 8 wherein the primary disc on the first shaft and the secondary disc on the second shaft maintain a substantially constant spacing during rotation and the secondary disc on the first shaft and the primary disc on the second shaft maintain a substantially constant spacing during rotation.

10. A screen according to claim 8 wherein each primary disc and associated secondary disc are formed from two pieces of steel, a first piece of steel comprising the primary disc and a second separate piece of steel comprising the associated secondary disc.

11. A screen according to claim 8 wherein each primary disc and associated secondary disc comprises a triangular shaped outer profile with arched sides.

12. A screen according to claim 8 wherein the primary disc is about half as wide as the associated secondary disc.

13. A screen according to claim 8 including the following:

a first frame section angled at an incline from a bottom end to a top end, a second frame located adjacent to the first frame section and angled at an incline from a bottom end to a top end;

multiple shafts attached on both the first and second frame section; and multiple primary discs and associated smaller secondary discs alternately aligned in rows on each one of the multiple shafts, each one of the primary discs laterally aligned with a secondary discs on adjacent shafts.

14. A screen according to claim 13 wherein each one of the primary discs is formed together with an associated one of the secondary discs from a unitary piece of rubber, the rubber discs allowing some of the material to roll off a bottom end of the first and second frame section while moving remaining material from the bottom end over the top end of the first and second frame section.

15. A method for separating material on a screen having multiple shafts, comprising:

providing multiple primary discs each having an outside perimeter and multiple secondary discs each having a smaller outside perimeter than the primary discs;

mounting the primary discs and the secondary discs on the shafts in alternating order where at least some of the primary discs are colinearly aligned with at least some of the secondary discs from adjacent shafts;

rotating the shafts in the same direction; and dropping materials on the screen so that shaft rotation causes the material to be pushed by the discs along the screen while at the same time separating the materials according to size.

16. A method according to claim 15 including shaping a perimeter of the primary and secondary discs so that the discs agitate the materials in an up and down motion while pushing the material along the screen.

17. A method according to claim 15 including forming each one of the primary discs together with an associated one of the secondary discs from a unitary piece of rubber.

18. A method according to claim 15 including the following steps:

placing the screen at an angle;

dropping the materials on the screen; and gripping a first portion of the materials with the rubber discs thereby moving said first portion of the materials over a top end of the screen while a second portion of the materials fall off a bottom end of the screen.

19. A method according to claim 18 including the following steps:

sifting out materials from the first portion of materials according to size while moving up a first screen section;

dropping the sifted materials over a top end of the first screen section onto a second screen section;

gripping portions of the dropped materials while other portions of the dropped materials roll off a bottom end of the second screen section;

sifting out the material moving up the second screen section according to size; and dropping the sifted materials over a top end of the second screen section.

20. A method according to claim 19 wherein all the primary and secondary discs each have arched sides that maintain a substantially constant spacing with colinearly aligned discs on adjacent shafts.

21. A disc for a material separation screen, comprising:

a primary disc having a first outside perimeter; and a secondary disc having a second outside perimeter smaller than the first outside perimeter;

the primary disc and the secondary disc formed from a unitary piece of molded rubber or plastic;

the primary disc located on a first shaft and maintaining a substantially constant spacing with a first adjacent disc on a second shaft during rotation and the secondary disc shaped to maintain a substantially constant spacing with a second adjacent disc on the second shaft during rotation.

22. A disc according to claim 21 wherein the primary disc and the secondary disc each comprise arched sides.

23. A disc according to claim 21 wherein the first outside perimeter and the second outside perimeter each comprises three arched sides.

24. A disc according to claim 21 wherein the secondary disc extends from a lateral side of the primary disc.

25. A disc according to claim 21 wherein the secondary disc is wider than the primary disc.

26. A disc according to claim 25 wherein the secondary disc is about twice as wide as the primary disc.

27. A disc for a material separation screen, comprising:

a primary disc on a first shaft having a first outside perimeter shaped to maintain a substantially constant spacing with a first adjacent disc on a second shaft during rotation;

a secondary disc on the first shaft having a second outside perimeter smaller than the first outside perimeter and shaped to maintain a substantially constant spacing with a second adjacent disc on the second shaft during rotation; and the primary disc and secondary disc made from a unitary piece of plastic or rubber type material that grips certain materials while allowing other materials to fall off the screen.

* * * * *